US005359870A

United States Patent [19]

Reutlinger

[11] Patent Number: 5,359,870

[45] Date of Patent: Nov. 1, 1994

[54] KEY CHAIN

[75] Inventor: Wolf Reutlinger, Frankfurt am Main, Germany

[73] Assignee: Seil-und Netztechnik Reutlinger GmbH, Frankfurt am Main, Germany

[21] Appl. No.: 954,729

[22] Filed: Sep. 30, 1992

[30] Foreign Application Priority Data

Oct. 1, 1991 [DE] Germany ..... 9112195[U]

[51] Int. Cl.[5] ..... A47G 29/10

[52] U.S. Cl. ..... 70/456 R; 24/3 K; 24/114.5; 24/115 H; 24/136 A; 70/459

[58] Field of Search ..... 70/49, 386, 456 R, 457, 70/459; 24/3 K, 136 A, 114.5, 115 H, 115 L, 706.8, 635

[56] References Cited

U.S. PATENT DOCUMENTS

| | | | |
|---|---|---|---|
| 351,063 | 10/1886 | McCormick | 70/49 |
| 1,197,117 | 9/1916 | Fried | 24/635 |
| 1,315,528 | 9/1919 | Schuler | 70/457 |
| 1,348,666 | 8/1920 | Schuler | 24/635 |
| 1,431,729 | 10/1922 | Fischer | 24/635 |
| 1,566,965 | 12/1925 | Johnson | 70/49 |
| 3,435,642 | 4/1969 | Del Pesco | 24/635 X |
| 3,994,521 | 11/1976 | Van Gompel | 24/136 A X |
| 4,067,403 | 1/1978 | Richmond et al. | 24/136 A X |
| 4,141,117 | 2/1979 | Van Gompel | 24/136 A X |
| 5,035,126 | 7/1991 | Biba | 70/49 X |

FOREIGN PATENT DOCUMENTS

| | | | |
|---|---|---|---|
| 441973 | 6/1910 | France | 24/136 A |
| 213 | of 1879 | United Kingdom | 70/49 |
| 1782 | of 1913 | United Kingdom | 24/136 A |
| 1880 | of 1913 | United Kingdom | 24/136 A |
| 276525 | 9/1927 | United Kingdom | 24/136 A |
| 1582951 | 1/1981 | United Kingdom | 70/49 |

*Primary Examiner*—Lloyd A. Gall
*Attorney, Agent, or Firm*—Anderson Kill Olick & Oshinsky

[57] ABSTRACT

A key chain including a base body, an attachment element, such as a rope, nylon cord, or the like, for attaching at least one key to the base body, and two locking devices located inside of the base body for securing clamping and free ends of the attachment element against axial displacement.

2 Claims, 3 Drawing Sheets

KEY CHAIN

BACKGROUND OF THE INVENTION

The invention relates to a key chain having a base body, a flexible attachment element, and a detachable locking member for retaining at least one key.

Numerous versions of key chains of the above-mentioned type are well known. As a base body, small figurines, small autocar models, and also valuable ornamental objects are used. Often the base bodies are so formed that they have more or less large surface for placing advertized messages thereon. To the base body is fastened a flexible attachment element, such as a chain, a rope, or a similar element to the free end of which is secured a detachable locking member for retaining at least one key. The locking member can be formed as a clevis-like member, as a clipper, or as a rope member.

The main object of the invention is an other type of a key chain.

SUMMARY OF THE INVENTION

According to the invention, there is provided a key chain in which the flexible attachment element is formed by a rope, a nylon cord, or the like having clamping and free ends, and the base body includes two fixing devices in which each end of the rope, the nylon cord, or the like is secured against axial displacement.

In one embodiment of a key chain according to the invention, one of the fixing devices comprises a clamping lock actuatable in response to a pull and having a member that selflocks in the pull direction for retaining the clamping end of the rope, the nylon cord, or the like, and the other of the fixing devices comprises a chamfered opening for retaining the free end of the rope, the nylon cord, or the like with appropriate means being provided at the free end. These fixing devices can be used with a base body formed as a cylinder, a rectangle, or a ball, etc. . . .

The present invention provides a large variation range as of designs of key chains so with regard to availability of surfaces for advertising. Both large surface sides of the base body are suitable for advertising purposes. The base body can be made of a plastic material, of metal. In some cases, the base body can be made of wood.

One of the advantages of the present invention is that a component part of a key chain according to the invention is a per se known clamping lock which is compatible with parts of the key chain used for advertizing.

Another advantage of the invention consists in that the base body completely encloses the clamping or locking mechanisms that retain respective ends of the flexible attachment elements. Therefore, the base body has a smooth outer surface. Locking and release of locking mechanism used in a key chain according to the present invention can be easily effected by any person. The clamping lock is released without difficulties by pressuring a headpiece projecting outside of the base body, so that the clamping end of the rope, nylon cord, or the like can be pulled out of the clamping Lock. Then, the existing key can be straighten out or taken off, and a new key can be attached to the key chain. After that, the clamping end of the flexible attachment element can be secured in the clamping lock by inserting it thereinto with simultaneously pressuring the headpiece and then releasing the headpiece that acts as an interlock. At that, the separate pieces of the clamping lock arrive at their locking position from which they can only be released again by applying pressure to the headpiece, e.g., with a fingertip.

BRIEF DESCRIPTION OF THE DRAWINGS

The objects and features of the present invention will become more apparent and the invention itself will be best understood from the following detailed description of the preferred embodiment when read with reference to the accompanying drawings, wherein.

DETAILED DESCRIPTION OF THE PREFERRED EMBODIMENTS

FIGS. 1 through 5 show different embodiments of key chains according to the present invention. A key chain of any of the embodiments of FIGS. 1–3 and 5 has a rectangular base body 6, and a key chain of the embodiment of FIG. 4 has a cylindrical base body 7.

Figure 1:
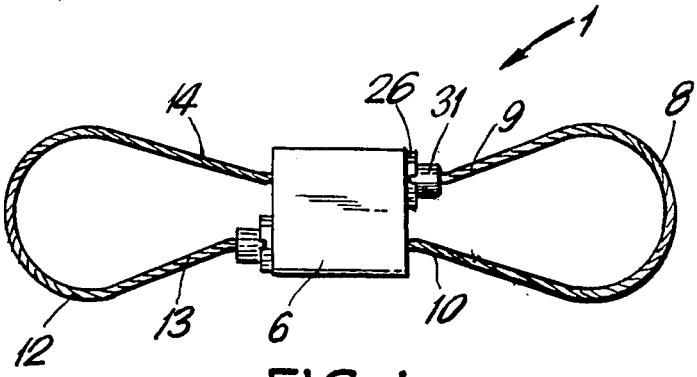
FIG. 1 shows a plan view of a first embodiment of a key chain according to the present invention.

A key chain 1 in FIG. 1 is provided with a nylon cord 12 at its left side and a rope 8 at its right side. The nylon cord 12 has a clamping end 13 and a free end 14. The clamping end 13 is securable in a clamping lock 23 described further below. The rope 8 has a clamping end 9 and a free end 10. The clamping end 9 of the rope 8 is likewise securable in another clamping lock 23 of which, as of the clamping lock 23 for the clamping end 13 of the nylon cord 12, only a portion of a cone socket 26 and a headpiece 31 are shown in FIG. 1. By applying pressure to the headpiece 31, the clamping lock inside the base body 6 can be unlocked so that the clamping end 9 of the rope 8 (the clamping end 13 of the nylon cord 12) can be pulled out. The base body 6, having, as it has been already mentioned previously, a rectangular shape, has two relatively big side surfaces for receiving advertising pictorial displays. The small side surfaces of the rectangular base body 6 can also be used for receiving thereon other advertising messages.

Figure 2:
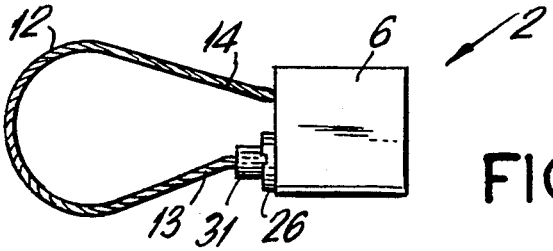
FIG. 2 shows a plan view of a second embodiment of a key chain according to the present invention.

A key can be attached to the key chain of FIG. 1 from two sides, whereas it can be attached to the key chain of FIG. 2 only from one side. The key chain of FIG. 2 is provided only with a nylon cord 12 having a clamping end 13 and a free end 14. Again, as in FIG. 1 only a portion of the cone socket 26 and the headpiece 31 are shown in the base body 6 of the key chain of FIG. 2, for advertising purposes, the big side surface can be used together with the end surface at the right side of the base body 6.

Figure 3:
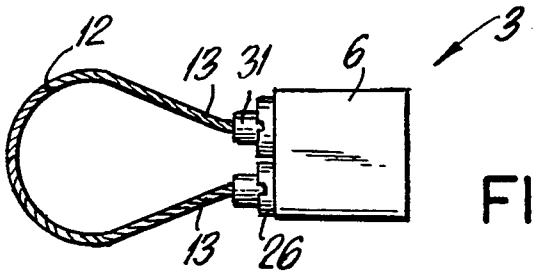
FIG. 3 shows a plan view of a third embodiment of a key chain according to the present invention.
Figure 4:
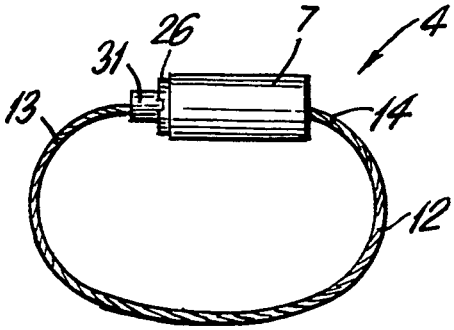
FIG. 4 shows a plan view of a fourth embodiment of a key chain according to the present invention.

In the key chain of FIG. 3, a single nylon cord 12 has two clamping ends 13 cooperating with two clamping locks 23 of which only portions of the cone sockets 26 and the headpieces 31 are shown.

In the key chain of FIG. 4, again only a single nylon cord 12 having a clamping end 13 and a free end 14, is associated with the cylindrical body 7 of the key chain 4. Here too, the surface of the cylindrical base body 7 is suitable for receiving advertisements.

Figure 5:
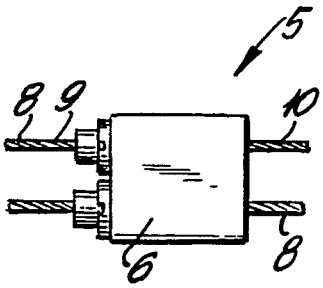
FIG. 5 shows a plan view of a fifth embodiment of a key chain according to the present invention.

FIG. 5 shows a somewhat modified key chain 5 whose base body b is associated with two ropes 8 whose clamping ends 9 are securable at the left side of the base body 6, and the free ends 10 are securable in a manner that will be described further below. The key chain 5 of FIG. 5, like the chain 1 in FIG. 1, provides two possibilities for attaching a key thereto, from the left and right sides, the ropes 8 extending from one end surface to the other end surface.

Figure 6:
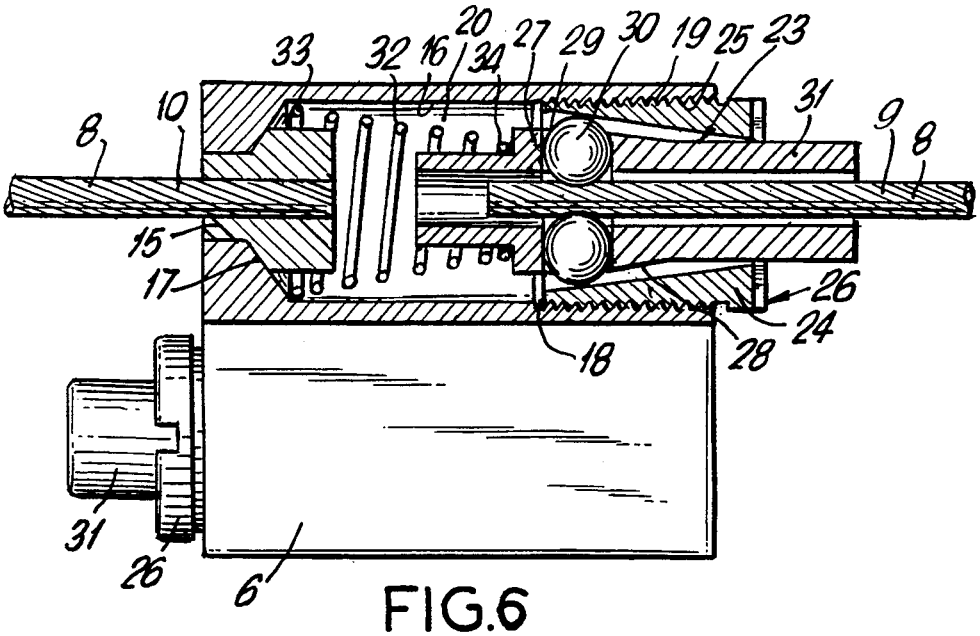
FIG. 6 shows a cross-sectional view of the base body of a key chain according to the present invention.
Figure 7:
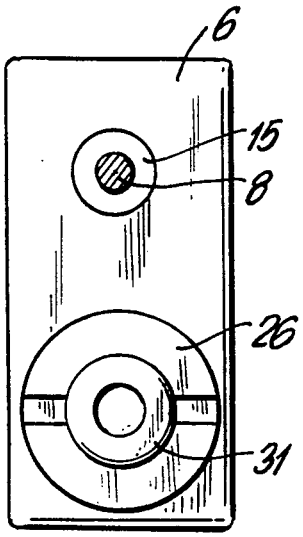
FIG. 7 shows a leftside view of the base body shown in FIG. 6.
Figure 8:
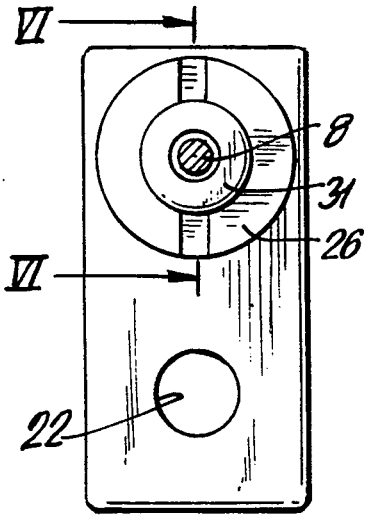
FIG. 8 shows a rightside view of the base body shown in FIG. 6.

As shown in FIG. 6, the base body 6 has, in its upper region, a clamping lock 23 at the right side thereof and, at the left side thereof, a nipple 15 to which the free end of the rope 8 is secured, preferably by soldering. The clamping lock is received in an increased diameter portion 18 of the bore 16 of the base body 6. The nipple 15 has a tubular neck portion (without a reference numeral), end surface of which can be seen in FIG. 7. The nipple 15 is received in passage 22 shown in FIG. 8. The neck portion of the nipple 15 ends with a bevel 17 which abuts a corresponding bevel of a bore 16 inside the base body 6. Thus, nipple 15 serves for securing the free end 10 of the rope 8 to the base body 6. The free end 10 of the rope 8 is fixed in the nipple by gluing or soldering.

Figure 9:
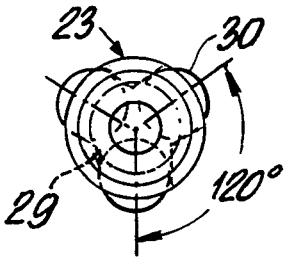
FIG. 9 shows a leftside view of a retaining element for the clamping end of a flexible attachment element, forming a part of the clamping lock used in a key chain according to the present invention.
Figure 10:
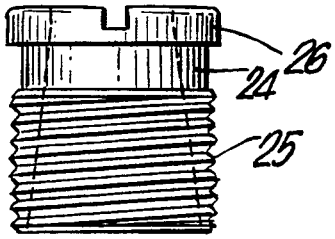
FIG. 10 shows a plan view of a socket assembly forming a part of the clamping lock used in a key chain according to the present invention.

The clamping end 9 of the rope 8 is received in the clamping lock 23. The clamping lock 23 includes a ball cage 27 having a leftward extending tubular projection (without a reference numeral). In the ball cage 27 which is tubular, there are provided radial openings 29 which, as shown in FIG. 9, extend at an angle of 120° to each other. Balls 30 are received in the openings 29. The balls 30 operatively engage the clamping end 9 of the rope 8. The ball cage 27 changes into a headpiece 31. The balls 30 lie in the outer region of a truncated-cone shaped inner surface of a tubular portion 24 of the cone socket 26, which surrounds; at least partially, the headpiece 31. The tubular portion 24 has an outer thread 25 for engaging an inner thread 19 of the increased diameter portion 18 of the bore 16 of the base body 6 for retaining the balls 30 as well as the headpiece 31. A cone socket 26, also shown in FIGS. 7, 8 and 10, serves for adjusting the engagement force of the balls 30 with the clamping end 9 of the rope 8. The portion of the tubular ball cage 27, in which openings 29 for receiving the balls 30 are formed, connected with the headpiece 31 by a transitional conical tubular portion 28.

The clamping lock 23 is loaded by a volute helical spring 32. The small diameter portion 34 of the spring 32 encompasses the tubular projection of the ball cage 27, and the large diameter portion 33 of the spring 32 encompasses the inner portion of the nipple 15 and abuts an edge of the bevel at the bottom of the bore 16. When a pressure is applied to the outer end of the headpiece 31 inward against the bias of the spring 32, the balls 30 are released , and the clamping end 9 of the rope 8 can be pulled out. Upon release of the clamping lock 23, the clamping end 9 of the rope 8 can again be inserted thereinto.

While the foregoing description was made with reference to ends of a rope, it would be similar in the case a nylon cord or the like is used.

The cylindrical base body 7 of the key chain 4 can have different cross-sections, e.g., four-cornered, three-cornered, oval, circular, six-cornered, and so forth. With an appropriate dimensioning, the inner form of the base body 7 can be the same as shown in FIG. 6.

Figure 11A:
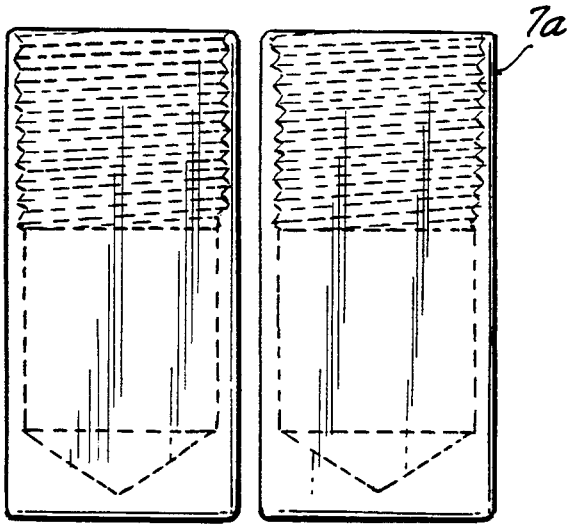
FIGS. 11*a*–11*f* show different embodiments of twin base bodies used in a key chain according to the present invention.
Figure 11C:
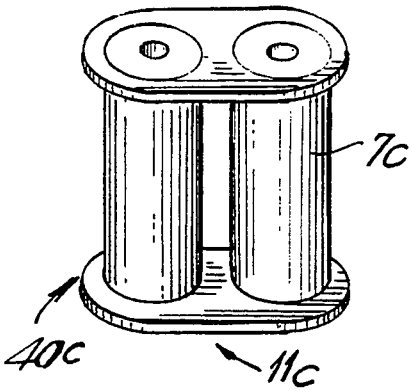
Figure 11B:
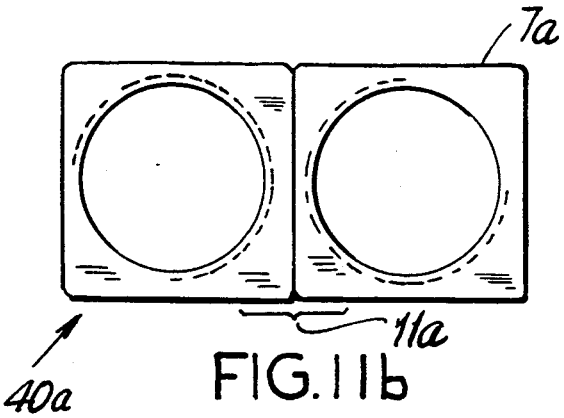
Figure 11D:
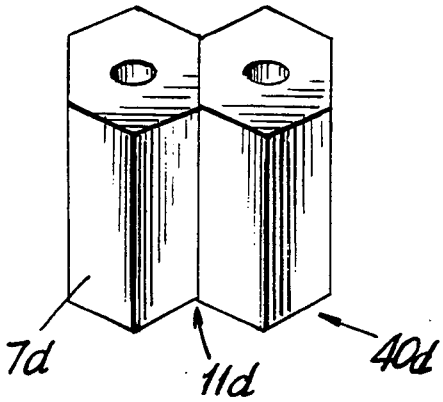
Figure 11E:
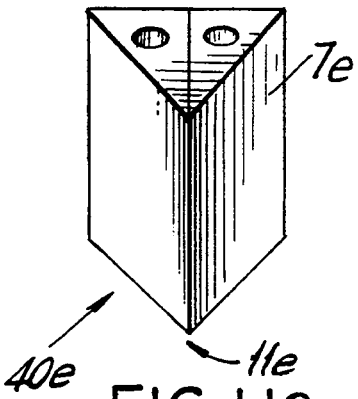
Figure 11F:
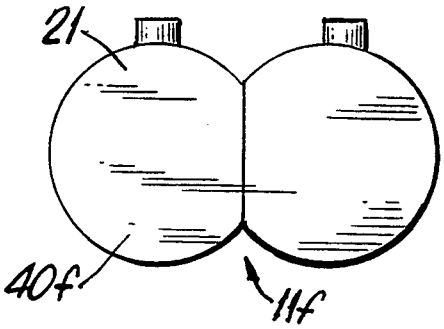

The base body 21 (FIG. 11*f*) of a key chain can also be formed as a ball. The inner form of cylindrical base bodies 7*a*–7*f* can be formed as shown in FIGS. 11*a* and 11*b*, namely, for receiving only a clamping lock 23. FIGS. 11*a*–11*f* show twin base bodies 11*a*–1*f* for key chains 40*a*–40*f*, respectively. The separate base bodies 7*a*–7*f* can be used for the key chain 4 of FIG. 4. In FIGS. 11*a*–11*f*, the respective twin base bodies 11*a*–11*f* are formed by connecting, preferably by gluing, separate base bodies 7*a*–7*f*. The base body 11*f* in FIG. 11 may be formed as separate balls.

While the invention has been described in terms of the preferred embodiments, numerous variations may be made in the structures herein shown and described without departing from the spirit and scope of the invention as set forth in the appended claims.

What is claimed is:

1. A key chain comprising a base body; at least one attachment element for attaching at least one key to said base body and having a clamping end and a free end; and locking means received within said base body for fastening said at least one attachment element to said base body, said locking means including at least two locking devices for securing said clamping end and said free end of said at least one attachment element, respectively, against axial displacement;

wherein said at least one attachment element is one of a rope and a nylon cord;

wherein one of said two locking devices comprises a pull-responsive clamping lock including self-locking in a pull direction means for retaining said clamping end of said one of a rope and a nylon cord, and another of said two devices comprises a nipple provided with a bevel for retaining said free end of said one of a rope and a nylon cord fixed to said nipple;

wherein said self-locking means comprises a displaceable tubular ball cage having a truncated conical tubular portion with a plurality of radial openings formed therein for receiving a corresponding plurality of balls, a cone socket surrounding said ball cage and having an inner surface, and a spring for biasing said ball cage in the pull direction to put said clamping lock in a locking condition thereof, said plurality of balls in the locking condition of said clamping lock firmly engaging said inner surface of said cone socket and said clamping end of said one of a rope and a nylon cord;

wherein said spring is formed as a volute helical spring; and wherein said base body has a bore having a first portion for receiving said clamping lock and a second reduced diameter portion for receiving said nipple, said bore having a bottom defining said second portion and provided with a bevel cooperating with said bevel of said nipple for retaining said free end of said one of a rope and a nylon cord, said ball cage having a tubular projection extending inward in said base body, said volute spring having a small diameter end supported on said tubular projection of said ball cage and a large diameter end engaging said bevel of said bottom of said bore.

2. A key chain as set forth in claim 1, wherein said volute spring envelopes a portion of said nipple.

* * * * *